US007222466B2

(12) United States Patent
Schipani et al.

(10) Patent No.: US 7,222,466 B2
(45) Date of Patent: May 29, 2007

(54) FOLDABLE SUPPORT STRUCTURE WITH HINGED SAWTOOTH WALL MEMBERS

(75) Inventors: Ralph L. Schipani, Edina, MN (US); Richard K. Strayer, Andover, MN (US); Mark Brauer, Minneapolis, MN (US); Walter Croll, Roberts, WI (US); Paul Miklautsch, Shakopee, MN (US); Patrick M. Hamilton, Golden Valley, MN (US); Charles Austen Angell, Minneapolis, MN (US); Jennifer Dianne Astwood, Robbinsdale, MN (US); Shaohui Qiu, Minneapolis, MN (US); Lee Powers, Cambridge, WI (US); Kyle Gudmunson, Edina, MN (US); Brian Clemens, Minneapolis, MN (US); Brett R. Johnson, Roseville, MN (US); Charles Graves, Woodbury, MN (US)

(73) Assignee: Eagle Development Corporation, Minneapolis, MN (US)

( * ) Notice: Subject to any disclaimer, the term of this patent is extended or adjusted under 35 U.S.C. 154(b) by 532 days.

(21) Appl. No.: 10/186,241

(22) Filed: Jun. 28, 2002

(65) Prior Publication Data

US 2004/0000620 A1 Jan. 1, 2004

(51) Int. Cl.
*E04H 12/18* (2006.01)

(52) U.S. Cl. ..... 52/646; 446/117; 446/487; 211/198; 182/152; 182/178.6

(58) Field of Classification Search ..... 52/641, 52/645, 646, 70, 71; 182/152, 115, 178.6; 211/195, 198, 201; 403/286–287, 293–294; 312/265.4; 446/117, 115, 105, 108–112, 446/106–107, 478, 487, 489, 85
See application file for complete search history.

(56) References Cited

U.S. PATENT DOCUMENTS

| | | | | | |
|---|---|---|---|---|---|
| 2,987,148 | A * | 6/1961 | Millard | 52/111 |
| 3,011,586 | A * | 12/1961 | Harvey, Jr. | 182/115 |
| 3,187,373 | A * | 6/1965 | Fisher | 16/324 |
| 3,908,564 | A | 9/1975 | Miller et al. | |
| 3,968,616 | A * | 7/1976 | Gostling | 52/645 |
| 4,054,013 | A * | 10/1977 | Pitto et al. | 52/641 |
| 4,286,353 | A * | 9/1981 | Roche | 16/341 |
| 4,557,097 | A * | 12/1985 | Mikulas et al. | 52/646 |
| 4,819,399 | A * | 4/1989 | Onoda | 52/646 |
| 4,939,882 | A * | 7/1990 | Filip | 52/652.1 |
| 4,958,800 | A * | 9/1990 | Carlson | 249/219.1 |
| 4,986,016 | A | 1/1991 | Wichman | |
| 5,016,418 | A * | 5/1991 | Rhodes et al. | 52/646 |
| 5,040,349 | A * | 8/1991 | Onoda et al. | 52/646 |
| 5,701,713 | A * | 12/1997 | Silver | 52/645 |

(Continued)

FOREIGN PATENT DOCUMENTS

WO PCT/NL00/00158 9/2000

*Primary Examiner*—Jeanette Chapman
(74) *Attorney, Agent, or Firm*—Altera Law Group, LLC

(57) ABSTRACT

A foldable truss member suitable for commercial displays includes a plurality of side members that are adjacently hinged together. The side members include support members and bridging members having extensions. The side members are joined into a foldable structure with a hinge member between the support member and extensions of adjacent side members. A display structure can be formed by connecting locking members between two truss members.

16 Claims, 4 Drawing Sheets

U.S. PATENT DOCUMENTS 5,822,945 A * 10/1998 Muller ..... 52/646
5,867,851 A * 2/1999 Mariol et al. ..... 5/99.1
5,900,850 A 5/1999 Bailey et al.
5,902,195 A * 5/1999 Pavonetti ..... 473/478
6,026,626 A 2/2000 Fisher
6,076,770 A * 6/2000 Nygren et al. ..... 244/159.5
6,149,021 A * 11/2000 Beaulieu ..... 211/201
6,219,009 B1 4/2001 Shipley et al.
6,219,974 B1 4/2001 Hoberman
6,233,881 B1 5/2001 Rainbolt
6,240,940 B1 6/2001 Carter
6,244,010 B1 6/2001 Sluiter
6,253,520 B1 7/2001 Houk
6,260,327 B1 7/2001 Pellock
6,266,030 B1 7/2001 Warren et al.
6,276,095 B1 8/2001 Tripsianes
6,276,521 B1 8/2001 Arndt et al.
6,283,136 B1 9/2001 Chen
6,293,500 B1 9/2001 Bigelow
6,296,077 B1 10/2001 Wood et al.
6,296,109 B1 10/2001 Nohl
6,374,565 B1 * 4/2002 Warren ..... 52/653.2
6,389,772 B2 * 5/2002 Gleckman et al. ..... 52/582.1
6,435,421 B1 * 8/2002 Peterson ..... 238/10 R
6,715,255 B2 * 4/2004 Schipani et al. ..... 52/646
2004/0111999 A1 * 6/2004 Schipani et al. ..... 52/646

* cited by examiner

FOLDABLE SUPPORT STRUCTURE WITH HINGED SAWTOOTH WALL MEMBERS

FIELD OF THE INVENTION

The present invention relates to portable support structures for use in temporary fixtures such as trade shows and conventions, and particularly to a portable folding truss system having identical hinging side elements.

BACKGROUND OF THE INVENTION

Commercial displays such as those used in trade show booths require strong structures that can be easily transported and configurable in a wide variety of forms. Such structures need to be lightweight, portable, and able to be quickly set up and broken down.

Prior art solutions have utilized truss members with folding elements that utilize rigid wall members coupled with rotatable wall members. The rotatable side members allow the truss to collapse. The trusses include internal diagonal pivoting members that serve to lock the truss into an open position. Although useful in some applications, this approach has deficiencies.

Using differently designed rigid and rotatable wall members increases the required inventory of piece parts needed to build the truss, thereby making the truss more complicated and expensive to manufacture. More importantly, the non-symmetry of the assembled structure (due to the non-rigidity of the rotatable wall members) gives such a truss non-uniform load bearing characteristics when deployed horizontally. Therefore, if the user is not careful and/or cognizant of the requirement for a certain orientation, a structure according to the prior art design might be deployed in an unsafe manner with potentially catastrophic results.

What is needed is a collapsible/foldable truss member that is strong, easy fabricated and easily assembled into a temporary or permanent structure for a commercial display or other structural application. What is further needed is a truss member that can be configured to provide horizontal support regardless of the truss member's orientation. The present invention fulfills these and other needs, and addresses other deficiencies of prior art implementations.

SUMMARY OF THE INVENTION

To overcome the limitations in the prior art described above, and to overcome other limitations that will become apparent upon reading and understanding the present specification, the present invention discloses a foldable truss member having a plurality of adjacently connected side members together forming a peripheral boundary of the truss member. Each side member includes an elongated support member with a side surface and a first end and a bridging member fixably connected to the side surface of the support member at an attachment point of the support member. The bridging member has an extension at an edge of the bridge member opposite the attachment point. A plurality of hinge members pivotably joins the extension of each side member to the support member of the adjacent side member. Each hinge member allows relative rotation of adjacent side members.

Each bridging member may include a sawtooth-shaped member having a first and second set of oppositely disposed peaks. The first set of peaks is attached to the attachment point of the associated support member. The extensions of each bridging member are formed by the second set of peaks.

At least one of the hinge members can be configured to resist relative rotation of the associated extension at the deployed configuration of the truss member. A hinge member may include an increased friction to resist relative rotation of the associated extension at the deployed configuration of the truss member. A hinge member may include a feature to elastically deform the associated extension to resist relative rotation of the associated extension at the deployed configuration of the truss member.

Each hinge member may include a mounting surface and a hinge channel breaking (i.e. bridging or spanning over) a portion of the mounting surface. The extensions of the bridging member of the adjacent side member are locatable within the hinge channel. The mounting surfaces fixably attach to the support members. The hinge channel of each of the hinge members may further include a first and second end, and the first and second ends are flared. The first and second ends may each include a center portion contacting the associated extension when the truss member is in the deployed configuration, at least one terminal portion contacting the associated extension when the truss member is in a folded configuration, and at least one intermediate portion contacting the associated extension when the truss member is in an intermediate configuration between the folded configuration and the deployed configuration. The intermediate portion can be made to offer a resistance to rotation of the associated extension, and the terminal portion can allow substantially free rotation of the associated extension. In one configuration, the center portion offers a resistance to rotation of the associated extension, the resistance of the center portion being less than the resistance of the at least one intermediate portion.

In another embodiment of the present invention, a foldable truss member includes a plurality of side member means. The side member means are adjacently arranged so that the lower edges of the adjacently arranged side member means form a closed shape. A plurality of pivoting means are connected between adjacently arranged side member means. The pivoting means allow relative rotation between adjacently arranged side member means so that the side member means are foldable into a substantially flat assembly.

Each of the side member means may include a sawtooth-shaped member and an elongated support member. The sawtooth-shaped member has a first and second set of oppositely disposed peaks. The first set of peaks is fixably attached to the support member. The second set of peaks form hinge extensions of the side members. The hinge extensions pivotably attach to the associated pivoting means. Each of the pivoting means may include a mounting surface and a hinge channel breaking a portion of the mounting surface. The mounting surface of each of the pivoting means fixably attaches to the support member of each of the side member means. The hinge extension of the adjacent side member means is locatable within the hinge channel. The hinging means may include friction means to resist relative rotation between adjacently connected side member means at a deployed configuration of the truss member. The hinging means may include elastic deformation means to resist relative rotation between adjacently connected side member means by elastically deforming a portion of the side member means at a deployed configuration of the truss member.

In another embodiment of the present invention, a foldable display structure, includes first and second truss members as described hereinabove. A plurality of locking mem bers is disposed between the first ends of the first truss member and the first ends of the second truss member, the first ends of the first truss member being adjacent to the first ends of the second truss member.

In one configuration, the first ends of the side members of the first and second truss members each include a recess. Each locking member can include a locking post, the locking posts receivable into the recesses of the side members. At least one locking member may include a locking hole, and the first ends of the associated side members of the first and second truss members each further include a locking hole. The locking members are removably connectable with the associated side members so that the locking hole of the locking members are in alignment with the locking hole of the associated side member. An elongated interference member may be included that is passable through any of the locking holes of the locking members and the locking hole of the associated side member to prevent relative motion of the side members with respect to the locking members.

In yet another embodiment of the present invention, a method of assembling a display structure involves forming a truss member by adjacently coupling a plurality of side members to form a peripheral boundary for the truss members. Each of the side members include an elongated edge pivotably attached to the adjacent side member. The truss member is put in an intermediate configuration by relatively rotating the adjacent side members about the elongated edges of the truss member until a resistance to relative rotation is encountered. The truss member is put in a deployed configuration by further relatively rotating the adjacent side members about the elongated edges until a decreased resistance is encountered.

The method may further involve slidably connecting an unconnected edge of a second truss member to an unconnected edge of the first truss member to connect the first and second truss members. A locking member can be slidably connected between the first and second truss members. A fastening member can be attached to the first and second truss members to positively connect the truss members together.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figure 1:
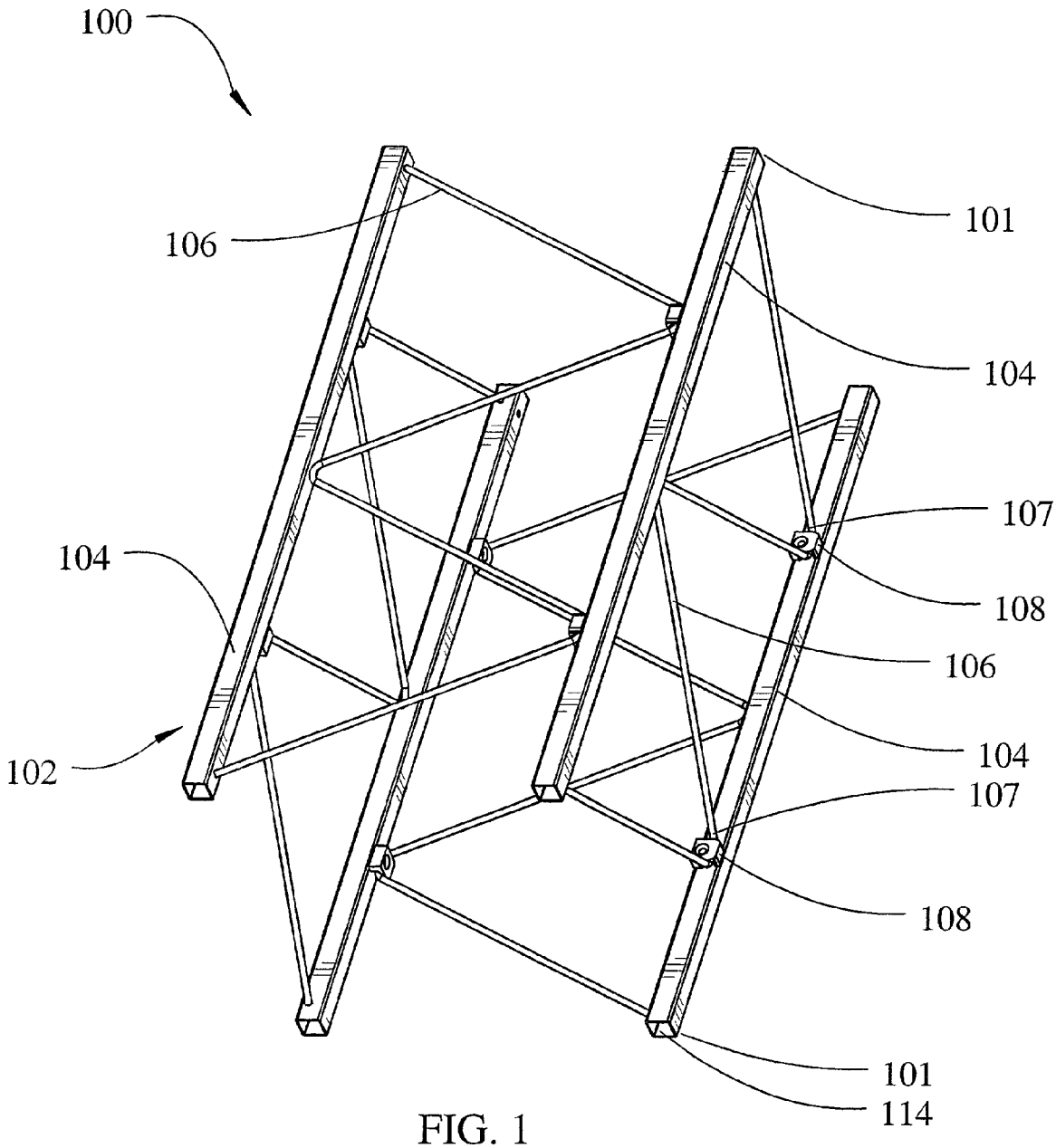
FIG. 1 is perspective view of a foldable truss according to one embodiment of the present invention.

While the invention is amenable to various modifications and alternative forms, specifics thereof have been shown by way of example in the drawings and will be described in detail herein. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF THE VARIOUS EMBODIMENTS

In the following description of the illustrated embodiments, references are made to the accompanying drawings which form a part hereof, and in which is shown by way of illustration, various embodiments in which the invention may be practiced. It is to be understood that other embodiments may be utilized, and structural and functional changes may be made without departing from the scope of the present invention.

Referring now to FIG. 1, a truss member, generally indicated by reference numeral 100, includes a plurality of side members 102. The side members 102 are adjacently connected to form a peripheral boundary of the truss member 100 such that lower (or upper) edges 101 of the side members 102 form a closed shape (e.g. a rectangle). The side members 102 include a support member 104 and a bridging member 106. The bridging members 106 in the illustrated embodiment are formed of a continuous length of tubular material formed into a generally planar sawtooth shape. The bridging members 106 include one or more extensions 107 located at an edge opposite where the bridging members 106 join the support members 104. In the configuration illustrated, the extensions 107 are located at distal angular corners of the sawtooth shape. The truss member 100 is formed by joining multiple side members 102 using a plurality of hinge members 108.

The edges 101 of the side members 102 may include receiving members 114. The receiving members 114 can be used to join multiple truss members 100 together to form a structure. The receiving members 114 in FIG. 1 are shown as recesses in the support members 104, although alternate configurations are possible.

The hinge members 108 shown in FIG. 1 are fixed to the support members 104 and pivotably join with the bridging member 106 of an adjacent side member 102. The hinge members 108 allow relative rotation of adjacent side members 102 while preventing the adjacent side members 102 from separating. In an especially useful configuration, the truss member 100 contains four, pivotable, side members 102, thereby allowing the truss member 100 to be folded substantially flat for storage and shipment.

The hinge members 108 can be configured to hold the truss member 100 in a deployed configuration. In a deployed configuration, the side members 102 are rotated to an orientation so that the truss member 100 takes on the shape desired for the intended installation. Typically, this shape is a rectangle or square (as exemplified in FIG. 1) although it may be desired to make the deployed shape a parallelogram, triangle, or other polygon. The hinge member 108 can include locking or frictional features that hold the side members 102 into position once the side members 102 are oriented in the deployed configuration. Details of the locking and/or frictional features of the hinge members 108 will be described at a later point hereinbelow.

Figure 2:
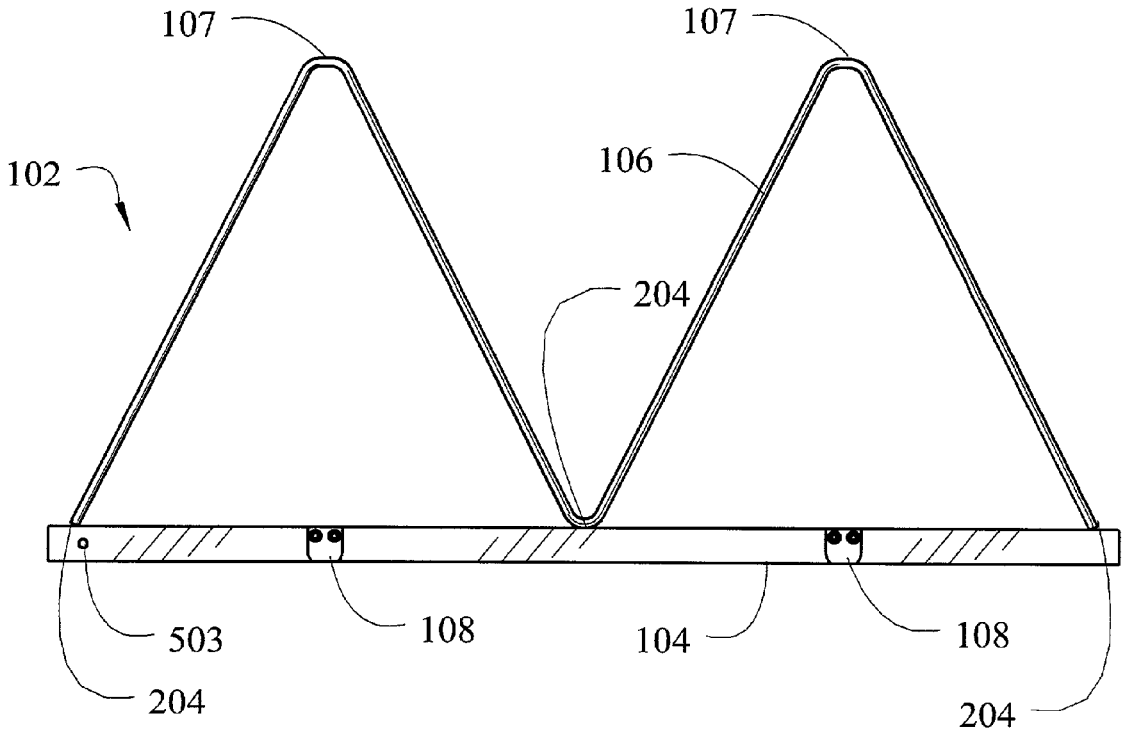
FIG. 2 is a side view of a side member according to an embodiment of the present invention.

Turning now to FIG. 2, a side view of an embodiment of a side member 102 is shown. The truss member 100 is formed by adjacently connecting a plurality of side members 102 to form the outer walls of the truss member. Note that the side members 102 can be made substantially identical. Not only does this reduce the number of fabricated piece parts required to fabricated the truss member 100, it is appreciated that a truss member 100 utilizing substantially identical side members will have symmetric transverse load characteristic (i.e. loads that are perpendicular to the long axis of the truss member). This makes such a truss member 100 ideal for horizontal installations, as there is no need for a preferred orientation of the side members 102.

The side member 102 is formed by fixably attaching a bridging member 106 to a support member 104. The support member 104 is preferably formed from a tubular material, although it need not be hollow. Any cross-sectional shape of the support member 104 is appropriate, although a rectangular, square, or round cross sectional shape is typically the most useful. The illustrated support member 104 is formed from a square tube material.

The bridging member 106 is fixed to one side of the support member 104 at attachment points 204. The bridging member 106 can be a tubular or bar member bent to a sawtooth shape and attached (e.g. welded or clamped) to the support member 104. It is appreciated that the bridging member 106 can alternatively be formed from various elements, including a pattern cut from a sheet or any elongated member (e.g. bar) formed into the desired shape. Further, although the bridging members 106 and other truss member components are typically made from metals (e.g. steel, aluminum, copper, brass, zinc, etc), the components can also be made alternate materials such as woods, plastics, carbon fiber and composites.

The bridging member 106 includes extensions 107 that interface with hinge members 108 of an adjacent side member 102. The hinge members 108 are attached to the support member 104 at a location on the support member 104 generally in alignment with the bridging member extensions 107. The hinge members 108 are typically removably (as opposed to permanently) attached, thereby making assembly easier and allowing for disassembly/reassembly of the truss member 100 for repairs.

Figure 3A:
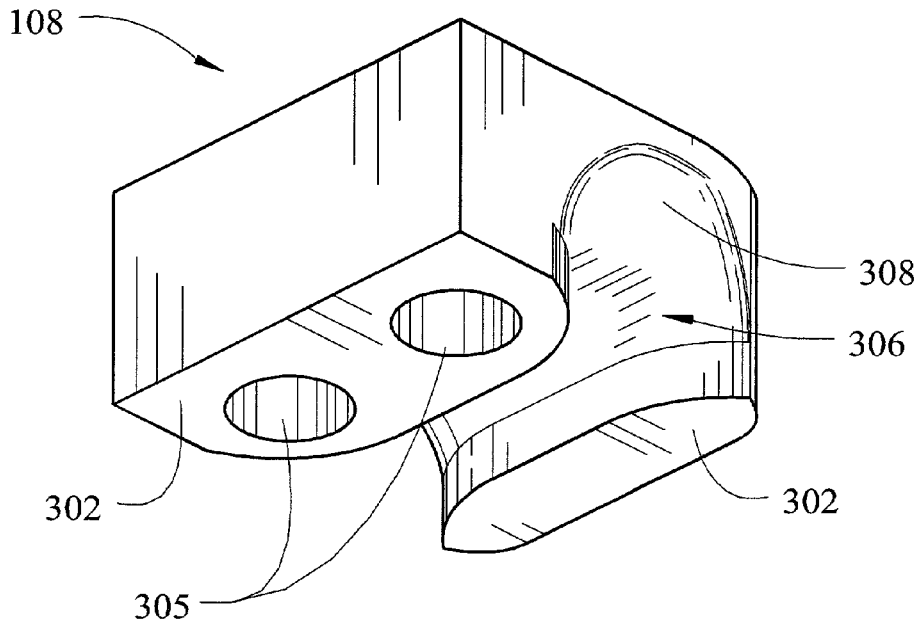
FIG. 3A is a perspective view of a hinge member according to one embodiment of the present invention.

FIG. 3A shows an embodiment of an attachable hinge member 108. The hinge member 108 includes a mounting surface 302 with mounting holes 305. The mounting holes 305 align with holes on the support member 102 (not shown). The mounting holes 305 are adapted to receive fasteners, such as bolts, screws, rivets, locking pins, etc. The hinge member 108 includes a hinge channel 306 for receiving the extension 107 of a bridging member 106 therethrough. The hinge channel 306 breaks through a portion of the mounting surface 302 and includes flared ends 308 that allow a generally curved extension 107 to freely rotate about 180 degrees within the hinge channel 306.

Figure 3B:
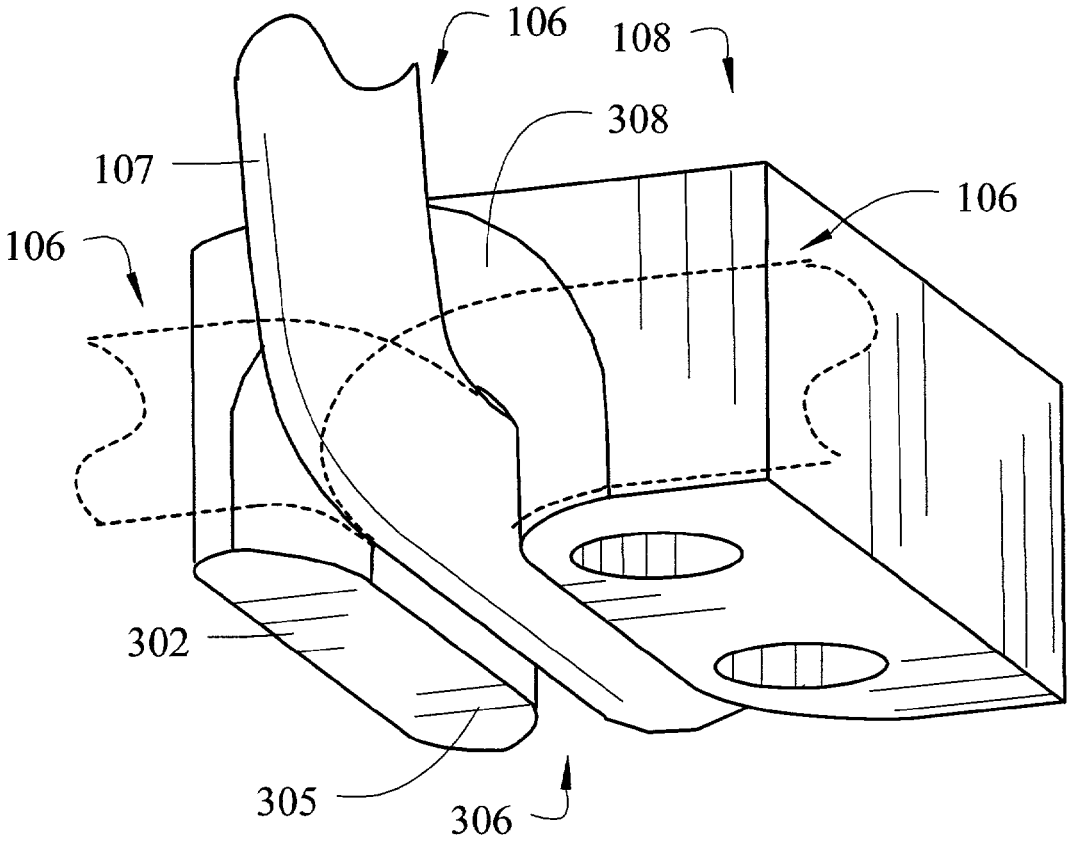
FIG. 3B is a perspective view of the hinge member interacting with a bridge member extension according to the present invention.

The hinge member 108 may include features that allow substantial locking of a truss member 100 into a deployed configuration. These features are detailed in FIGS. 3B and 3C. In FIG. 3B, a portion of a bridging member 106 is shown in solid line with the extension 107 located within the hinge channel 306 oriented in a typical deployed configuration of the truss member 100. The orientations of the bridging member 106 corresponding to the folded configurations of the truss member 100 are shown using broken lines. Between the orientations illustrated are intermediate configurations, where the bridging member 106 is located when truss member 100 is being folded or deployed. In one embodiment, the hinge member 106 includes features that hold the extension 107 in a deployed configuration by using either friction and/or elastic deformation of the extension 107.

Figure 3C:
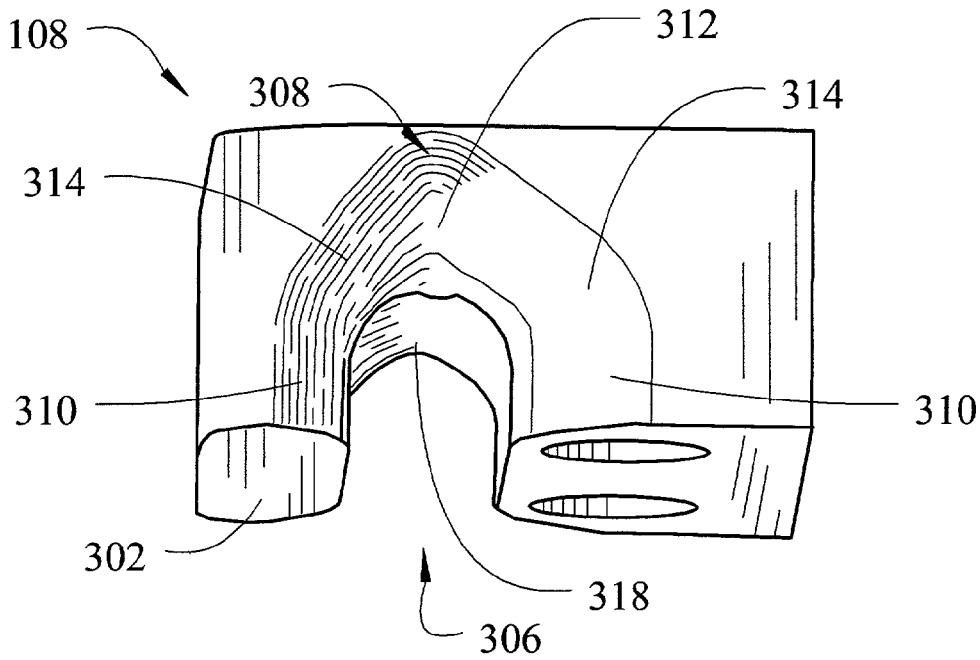
FIG. 3C is a perspective view of an alternate hinge member illustrating locking features according to the present invention.

An example is shown in FIG. 3C, where the flared end 308 of the hinge channel 306 includes three portions of differing geometry. These portions include one or more terminal portions 310, a center portion 312 and one or more intermediate portions 314. These portions 310, 312, 314 correspond to the orientation of the extension 107 within the hinge member 106 when the truss member 100 is in the folded, deployed, and intermediate configurations, respectively. The terminal portions 310 are designed to offer little or no interference with the extension 107, thereby allowing easy rotation of side members 102 in the folded configuration. The intermediate portions 314 offer resistance at least where the intermediate portions 314 are adjacent the center portion 312. The center portion 312 typically offers some resistance to rotation of the extension 107, although preferably less resistance than the intermediate portions 314. Having less resistance at the center portion 312 gives the user feedback that the truss member 100 has attained the deployed configuration, because the extensions 107 will "snap" into center portion 312.

The portions 310, 312, 314 can offer changing resistance to rotation of the extension by various means. In the example of FIG. 3C, the portions 310, 312, and 314 are formed by fillets that form the hinge channel 308. It is appreciated that forming a fillet radius different than the inner bend radius of the extension 107 will cause the fillets to ride (interfere) at contact points against portions of the extension 107. Also, the portions 310, 312, 314 are arrayed generally radially about a rounded portion 318 of the hinge channel 306. The rounded portion 318 has a substantially constant semicircular profile throughout the hinge channel 306 in order to effectively restrain the side members 102 during deployment of the truss member 100. The portions 310, 312, 314 may have varying shapes and be located varying radial distances from the rounded portion 318 in order to increase or decrease interference with the extension 107. For example, the intermediate portions 314 are located radially closer to the rounded portion 318 than the other portions 310, 312 and are somewhat flattened, thereby giving the flared end 308 a peaked appearance. In this way, the intermediate portion 314 causes an increase in friction and/or elastic deformation of the extension 107, thereby resisting rotation of the extension 107.

Truss members 100 may be constructed that have a large number of extensions 107 along the side members 102. In this case, it may be desirable to include a mixture of hinge members 108 alternately configured according the configurations shown in both FIG. 3A and FIG. 3C. This allows the folding action of the truss assembly 100 to be "tuned", so that holding forces are not excessive while still allowing the hinge members 108 to hold the truss member 100 in the deployed configuration.

A truss member 100 can be assembled by locating the extensions 107 of a first side member 102 within the channels 306 of associated hinge members 108. The hinge members 108 are then attached to the support member 104 of a second side member 102, trapping the extensions 107 of the first side member 102 between the hinge members 108 and the support member 104. This process is repeated for all side members 102 so the side members 102 form a closed periphery.

Figure 4:
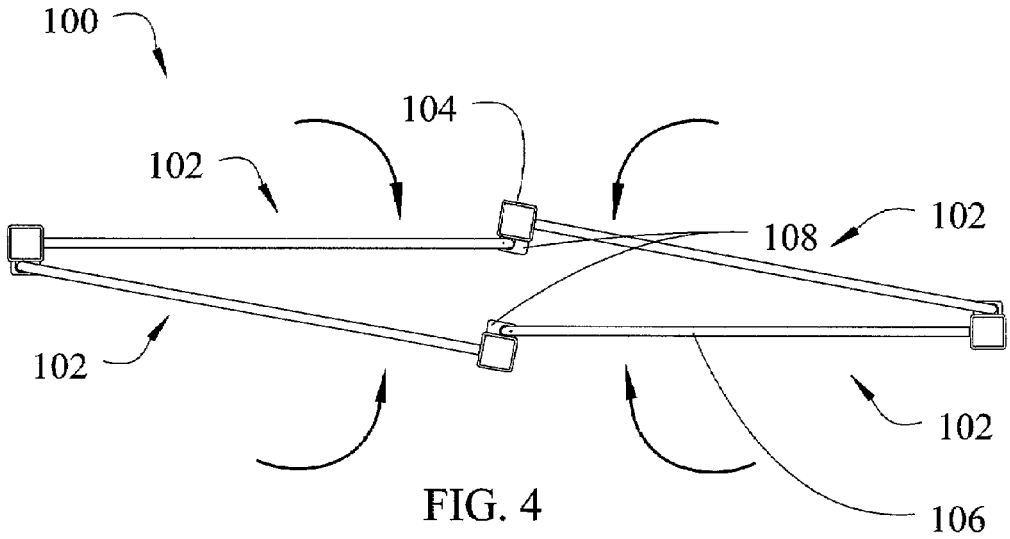
FIG. 4 is an end view of the foldable truss member showing a partially folded configuration.

After assembly, the truss member 100 can be expanded for use or folded into a substantially flat folded configuration for storage or transport. FIG. 4 illustrates an end view of a partially folded truss member 100. The truss member 100 is folded by moving the side members 102 in the direction indicated by the curved arrows in FIG. 4. While being folded, the adjacent side members 102 rotate relative to each other at the edges of the side members 102 joined by the hinge members 108. Expanding the truss member 100 to the deployed configuration involves moving the side members 102 in a direction opposite that indicated by the curved arrows.

Figure 5:
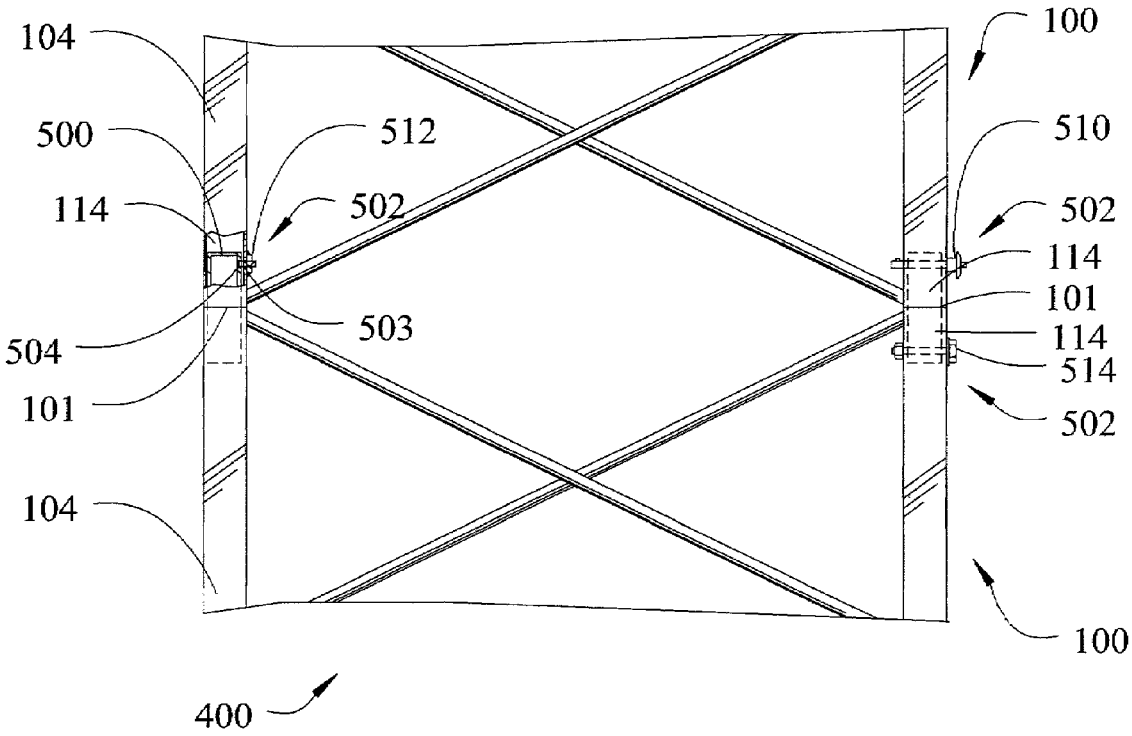
FIG. 5 is a partial side view of a display structure according to one embodiment of the present invention.

FIG. 5 is a partial view of a display structure 400 created by connecting two truss members 100 to using locking members 500. The first and second truss members 100 are expanded to the deployed configuration and placed with edges 101 facing each other. The locking members 500 are slidably attached to the receiving ends 114 on the edges 101 of the first truss member 100. The second truss member 100 is similarly attached to the locking members 500 and thereby rigidly coupled to the first truss member 100.

A fastening member (e.g interference members) 502 can be used to create a positive locking engagement between the locking members 500 and the truss members 100. Support member holes 503 (best seen in FIG. 2) and locking member holes 504 are included. During assembly, the holes 503, 504 and aligned so that fastening members 502 can be placed through the holes 503, 504. In this example, exemplary fastening members 502 include a quick release pin 510, a welded nut/lockscrew assembly 512 and a nut/bolt assembly 514. Other fastening members 502 such as clips, rivets, wire ties, snaps, etc., can also be used to fasten trusses and locking members 100, 500.

The truss member 100 and display structure 400 according to the present invention can be beneficially be adapted for all manner of structural uses, particularly those of a temporary or seasonal nature. In particular, one such configuration desirable for uses such as displays or point of sale fixtures is described herein in detail. A truss member 100 having approximately 12"×12" cross sectional dimensions is preferable in these applications. The individual truss member lengths can vary from about 6" to about 80". The support members 102 are formed from ¾" to 1" square steel tubing welded to 3/16" wire lacing forming the bridging members 106. The hinge members 108 are investment cast from steel and finished with a smooth finish along the hinge channel surfaces 306. Fabricating the truss assembly 100 from steel offers advantages of low cost, high strength, and magnetic properties for easy attachment of magnetic graphics. The steel is typically powder coated for appearance and corrosion resistance. The support members can be of different sizes and of different materials than stated above, such as round tubes and plastics, aluminum or other materials with sufficient strength. In general, the strength of coupled truss members 100 in this specific application should be able to be safely used over a 40 foot span with no load. Loads up to a few hundred pounds can be supported either applied centrally or distributed. Such load bearing capability would enable the truss to safely support item such as computer or TV monitors, lights and signage, typically used in an exhibit/display. The weight of the truss member 100 so configured will range from ½ pound to 10 lbs for truss lengths between 6" and 80"

It will, of course, be understood that various modifications and additions can be made to the preferred embodiments discussed hereinabove without departing from the scope of the present invention. Accordingly, the scope of the present invention should not be limited by the particular embodiments described above, but should be defined only by the claims set forth below and equivalents thereof.

What is claimed is:

1. A foldable truss member, comprising:

a plurality of adjacently connected side members together forming a peripheral boundary of the truss member, each side member comprising:

an elongated support member having a side surface and a first end;

a bridging member fixably connected to the side surface of the support member at an attachment point of the support member, the bridging member having an extension at an edge of the bridge member opposite the attachment point; and a plurality of hinge members pivotally joining the extension of each side member to the support member of the adjacent side member, each hinge member allowing relative rotation of adjacent side members in a folded configuration of the truss member, and wherein the hinge members comprise a mounting surface and a hinge channel breaking a portion of the mounting surface, the extensions of the bridging member of the adjacent side member locatable within the hinge channel, the mounting surface of the hinge members fixably attaching to the support members.

2. The truss member of claim 1, wherein the hinge channel of at least one of the hinge members further comprises a first and second end, and the first and second ends are flared.

3. The truss member of claim 1, wherein the hinge channel of at least one of the hinge members further comprises a first and second end, the first and second ends comprising:

a center portion contacting the associated extension when the truss member is in the deployed configuration;

at least one terminal portion contacting the associated extension when the truss member is in a folded configuration; and at least one intermediate portion contacting the associated extension when the truss member is in an intermediate configuration between the folded configuration and the deployed configuration.

4. The truss member of claim 3, wherein the at least one intermediate portion offers a resistance to rotation of the associated extension, and the at least one terminal portion allows substantially free rotation of the associated extension.

5. The truss member of claim 3, wherein the center portion offers a resistance to rotation of the associated extension, the resistance of the center portion being less than the resistance of the at least one intermediate portion.

6. A foldable truss member, comprising:

a plurality of side member means, each side member means having a lower edge, the side member means adjacently arranged so that the lower edges of the adjacently arranged side member means form a closed shape; and a plurality of hinging means connected between adjacently arranged side member means, the hinging means allowing relative rotation between adjacently arranged side member means so that the side member means are foldable into a substantially flat assembly, wherein the hinge mean are configured provide holding resistive forces to hold the truss member in a deployed position and to effectively restrain the side members from collapse during deployment, wherein each of the side member means comprises a sawtooth-shaped member and an elongated support member, the sawtooth-shaped member having a first and second set of oppositely disposed peaks, the first set of peaks fixably attached to the support member, and the second set of peaks forming hinge extensions of the side members, the hinge extensions pivotally attachable to the associated hinging means, and wherein each of the hinging means comprise a mounting surface and a hinge channel bridging over a portion of the mounting surface on one side and together with the mounting surface, forming a restricted passage for the extensions, the mounting surface of each of the hinging means fixably attaching to the support member of each of the side member means, the hinge extension of the adjacent side member means locatable within the hinge channel.

7. A foldable display structure, comprising:

(A) a first and second truss member, each truss member comprising:

(1) a plurality of adjacently connected side members, each side member comprising:

(a) an elongated support member having a side surface and a first end; and (b) a bridging member fixably connected to the side surface of the support member at an attachment point of the support member, the bridging member having an extension at an edge of the bridge member opposite the attachment point; and (2) a plurality of hinge members pivotally joining the extension of each side member to the support member of the adjacent side member, each hinge member allowing relative rotation of adjacent side members; and (B) a plurality of locking members disposed between the first ends of the first truss member and the first ends of the second truss member, the first ends of the first truss member being adjacent to the first ends of the second truss member, and wherein each of the hinge members comprise a mounting surface and a hinge channel spanning over a portion of the mounting surface, the extensions of the bridging member of the adjacent side member locatable within the hinge channel, the mounting surface of the hinge members fixably attaching to the support members.

8. The display structure of claim 7, wherein at least one of the hinge members of each of the truss members elastically deforms the associated extension to resist relative rotation of the associated extension at the deployed configuration of the truss member.

9. The display structure of claim 7, wherein the hinge channel of each of the hinge members further comprises a first and second end, and the first and second ends are flared.

10. The display structure of claim 7, wherein at least one of the hinge channels further comprise a first and second end, each end comprising:

a center portion contacting the associated extension when the truss member is in the deployed configuration;

at least one terminal portion contacting the associated extension when the truss member is in a folded configuration; and at least one intermediate portion contacting the associated extension when the truss member is in an intermediate configuration between the folded configuration and the deployed configuration.

11. The display structure of claim 10, wherein the at least one intermediate portion offers a resistance to rotation of the associated extension, and the at least one terminal portion allows substantially free rotation of the associated extension.

12. The display structure of claim 10, wherein the center portion offers a resistance to rotation of the associated extension, the resistance of the center portion being less than the resistance of the at least one intermediate portion.

13. A foldable truss member, comprising:

a plurality of side member means, each side member means having a lower edge, the side member means adjacently arranged so that the lower edges of the adjacently arranged side member means form a closed shape; and a plurality of hinging means connected between adjacently arranged side member means, the hinging means allowing relative rotation between adjacently arranged side member means so that the side member means are foldable into a substantially flat assembly, and wherein each of the side member means comprises a sawtooth-shaped member and an elongated support member, the sawtooth-shaped member having a first and second set of oppositely disposed peaks, the first set of peaks fixably attached to the support member, and the second set of peaks forming hinge extensions of the side members, the hinge extensions pivotably attachable to the associated hinging means and wherein each of the hinging means comprise a mounting surface and a hinge channel bridging over a portion of the mounting surface, the mounting surface of each of the hinging means fixably attaching to the support member of each of the side member means, the hinge extension of the adjacent side member means locatable within the hinge channel.

14. The display structure of claim 13 wherein at least one of the hinge members of each of the truss members elastically deforms the associated extension to resist relative rotation of the associated extension at the deployed configuration of the truss member.

15. The display structure of claim 1 wherein at least one of the hinge members of each of the truss members elastically deforms the associated extension to resist relative rotation of the associated extension at the deployed configuration of the truss member.

16. The display structure of claim 6 wherein at least one of the hinge members of each of the truss members elastically deforms the associated extension to resist relative rotation of the associated extension at the deployed configuration of the truss member.

* * * * *